US011143367B2

(12) United States Patent
Yuan et al.

(10) Patent No.: US 11,143,367 B2
(45) Date of Patent: Oct. 12, 2021

(54) DOWN LAMP

(71) Applicant: NINGBO GANPE OPTOELECTRONICS CO., LTD., Ningbo (CN)

(72) Inventors: Liu Yuan, Ningbo (CN); Xiangjun Yu, Ningbo (CN)

(73) Assignee: Ningbo Ganpe Optoelectronics Co., Ltd., Ningbo (CN)

( * ) Notice: Subject to any disclaimer, the term of this patent is extended or adjusted under 35 U.S.C. 154(b) by 0 days.

(21) Appl. No.: 16/882,761

(22) Filed: May 26, 2020

(65) Prior Publication Data

US 2021/0033251 A1 Feb. 4, 2021

(30) Foreign Application Priority Data

Aug. 1, 2019 (CN) ..... 201910705108.3

(51) Int. Cl.

| | |
|---|---|
| ***F21S 8/02*** | (2006.01) |
| ***F21V 17/06*** | (2006.01) |
| ***F21V 17/12*** | (2006.01) |
| ***F21V 21/02*** | (2006.01) |
| ***F21V 15/01*** | (2006.01) |
| *F21Y 101/00* | (2016.01) |

(52) U.S. Cl.

CPC ..... *F21S 8/02* (2013.01); *F21V 15/01* (2013.01); *F21V 17/06* (2013.01); *F21V 17/12* (2013.01); *F21V 21/02* (2013.01); *F21Y 2101/00* (2013.01)

(58) Field of Classification Search

CPC .. F21S 8/02; F21V 17/06; F21V 15/01; F21V 21/02; F21V 17/12; F21Y 2101/00

See application file for complete search history.

(56) References Cited

U.S. PATENT DOCUMENTS

| | | | | |
|---|---|---|---|---|
| 5,738,436 | A * | 4/1998 | Cummings | F21S 2/00 362/294 |
| 10,393,359 | B1 * | 8/2019 | Qi | F21V 23/008 |
| 10,753,558 | B2 * | 8/2020 | Danesh | F21V 23/003 |
| 2012/0327608 | A1 * | 12/2012 | Rogers | H01L 27/12 361/728 |
| 2018/0310381 | A1 * | 10/2018 | Bowen | F21V 23/04 |
| 2019/0178453 | A1 * | 6/2019 | Zeng | F21V 29/717 |
| 2019/0226671 | A1 * | 7/2019 | Huang | F21V 29/74 |

FOREIGN PATENT DOCUMENTS

CN 102022682 B * 6/2012

OTHER PUBLICATIONS

CN 102022682 (A) machine translation Apr. 2011 (Year: 2011).*

* cited by examiner

*Primary Examiner* — Tracie Y Green
(74) *Attorney, Agent, or Firm* — W&K IP

(57) ABSTRACT

The present invention discloses a down lamp, comprising a housing and a wiring terminal (1) disposed in the housing, and the housing comprises a front shell (2) and a rear cap (3), wherein the rear cap (3) has an opening (4) at the location corresponding to the wiring terminal (1) and the opening (4) is provided with a terminal cap (5) that is matched with the opening and is in detachable connection with the rear cap (3), which is convenient in wiring.

9 Claims, 8 Drawing Sheets

DOWN LAMP

CROSS-REFERENCE TO RELATED APPLICATIONS

This application claims priority to Chinese Patent Application No. 201910705108.3 with a filing date of Aug. 1, 2019. The content of the aforementioned applications, including any intervening amendments thereto, are incorporated herein by reference.

TECHNICAL FIELD

The present invention relates to the technical field of lighting fittings, in particular to a down lamp.

BACKGROUND

A down lamp is a lamp that the lamp body is internally provided with a light source component, and the reflective surface of the lamp body is used to reflect the light rays emitted from the light source component so as to give off uniform light.

The housing of the down lamp is internally provided with a wiring terminal. In the prior art, in case of a wiring operation, there requires to open the rear cap on the housing and then to carry out wiring. Apparently, such wiring way is inconvenient.

SUMMARY

The technical problem to be settled by the present invention is to provide a down lamp with convenience in wiring.

The technical solution adopted by the present invention to resolve the above technical problem provides a down lamp, which comprises a housing and a wiring terminal disposed in the housing, and the housing comprises a front shell and a rear cap; the rear cap has an opening at the location corresponding to the wiring terminal; the opening is provided with a terminal cap that is matched with the opening and is in detachable connection with the rear cap.

As a preferred embodiment, the wiring terminal and the terminal cap are in detachable connection.

As a preferred embodiment, the terminal cap and the wiring terminal are in buckling connection.

As a preferred embodiment, the terminal cap is provided with a wire guiding structure thereon for guiding a connecting wire extending out from the wiring terminal.

As a preferred embodiment, the terminal cap is provided with a wire pressing block thereon for tightly pressing a connecting wire extending out from the wiring terminal.

As a preferred embodiment, the terminal cap is provided with an insertion piece, and the opening of the rear cap has a supporting rib and a slot for insertion of the insertion piece.

As a preferred embodiment, the down lamp is also provided with a first mounting base and a second mounting base, and the first mounting base is detachably connected to the rear cap for embedded-in mounting of the down lamp; and the second mounting base is detachably connected to the rear cap for surface mounting of the down lamp.

As a preferred embodiment, the first mounting base is detachably connected to the rear cap via screws, and the second mounting base and the rear cap are in rotary buckling.

As a preferred embodiment, the rotary bucking between the second mounting base and the rear cap means that there is a clamping slot in the rear cap, a lug matched with the clamping slot is disposed on the second mounting base, and the clamping slot is provided with a gap for stretching in of a limiting lug at one side, and a positioning bar for clamping the limiting lug into the clamping slot at the other side.

As a preferred embodiment, one side of the positioning bar distal to the gap is provided with a subsidiary slot of which the portion proximal to the positioning bar is provided with a recess.

By adopting the above structure, as compared to the prior art, the down lamp disclosed by the present invention has the following advantages: the rear cap is provided with an opening thereon, and a terminal cap matched with the opening is disposed. Therefore, when in wiring, the terminal cap is opened to take out the wiring terminal for wiring, so that wiring becomes easy.

The wiring terminal and the terminal cap are in buckled connection, such that the wiring terminal is secured on the terminal cap. In this way, the wiring terminal is prevented from arbitrary movement, and mounting and fixing become convenient.

By disposing a wire guiding structure, a power wire extending out from the wiring terminal is located and guided.

By disposing a wire pressing block, a power wire extending out is tightly pressed so as to prevent pulling and loosening of the power wire.

The insertion piece is matched with the insertion slot to realize the installation of the terminal cap, therefore, the terminal cap can be assembled and dissembled conveniently.

There are two mounting bases on the rear cap of the housing both in a detachable manner, thereby facilitating mounting. Further, a manufacturer merely needs to manufacture the housing and two mounting bases, therefore, even if one mounting base is not sold well, the influence produced thereby is less.

By fixing the second mounting base in a rotary buckling manner, the assembly and disassembly are convenient, and fixation is steady.

By adopting the above structure to achieve rotary buckling, operation is convenient. Moreover, the lug is better clamped due to the disposed positioning bar so that fixation is steady.

Elasticity of the positioning bar is increased by disposing the subsidiary slot, and when the lug is clamped in the clamping slot, the positioning bar pops up to give a sound that reminds a user of completion of rotary buckling.

Figure 1:
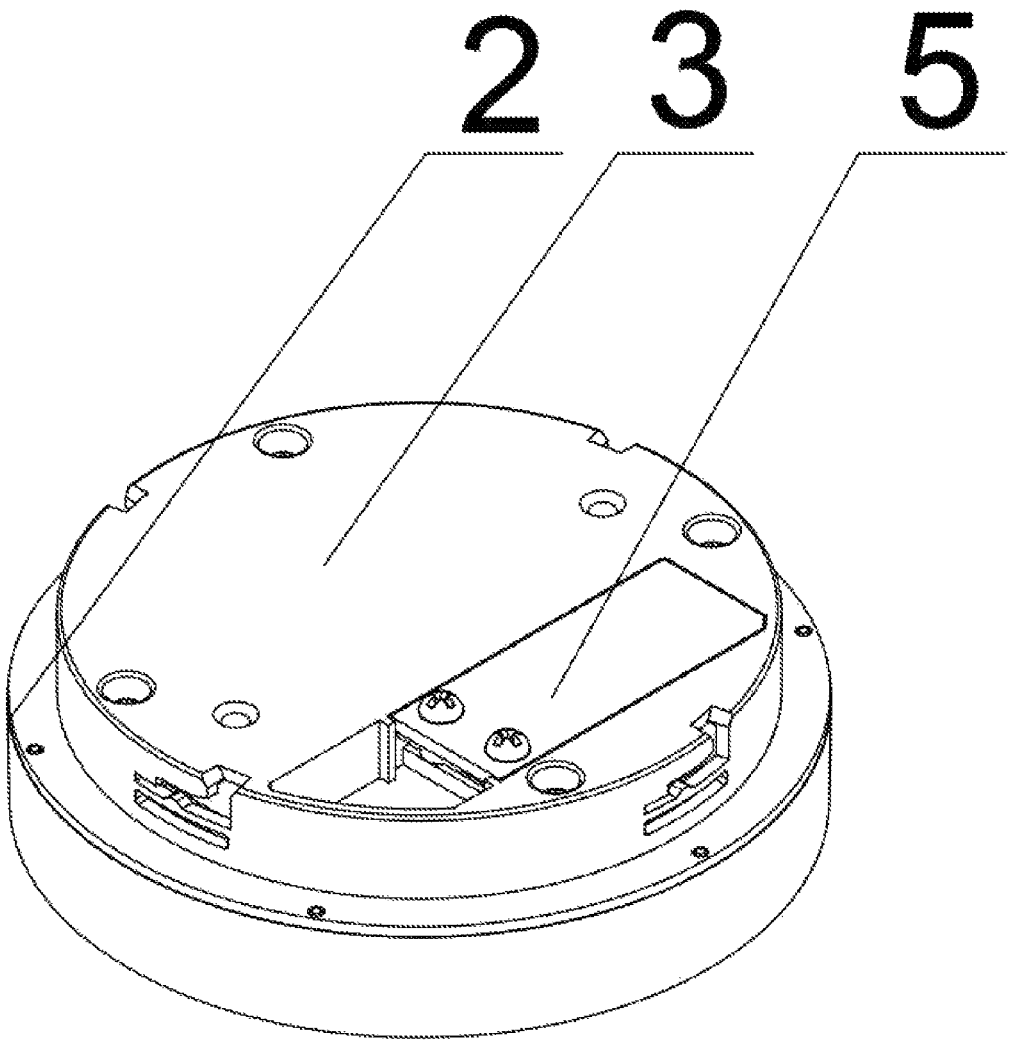
FIG.1 is a schematic structural diagram of a down lamp of the present invention, with mounting bases removed.
Figure 2:
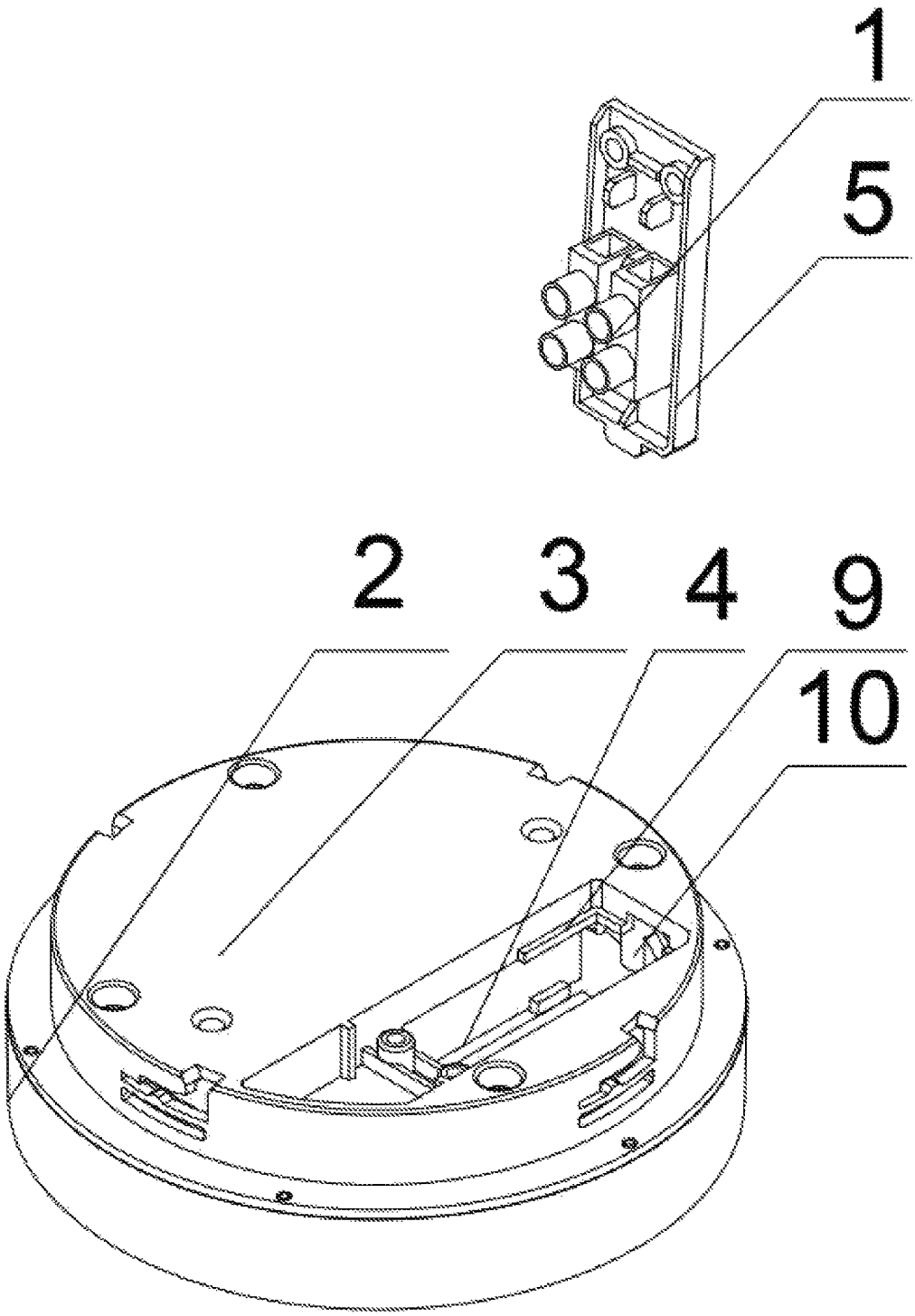
FIG.2 is a partial exploded view of the down lamp of the present invention, with the mounting bases removed.
Figure 3:
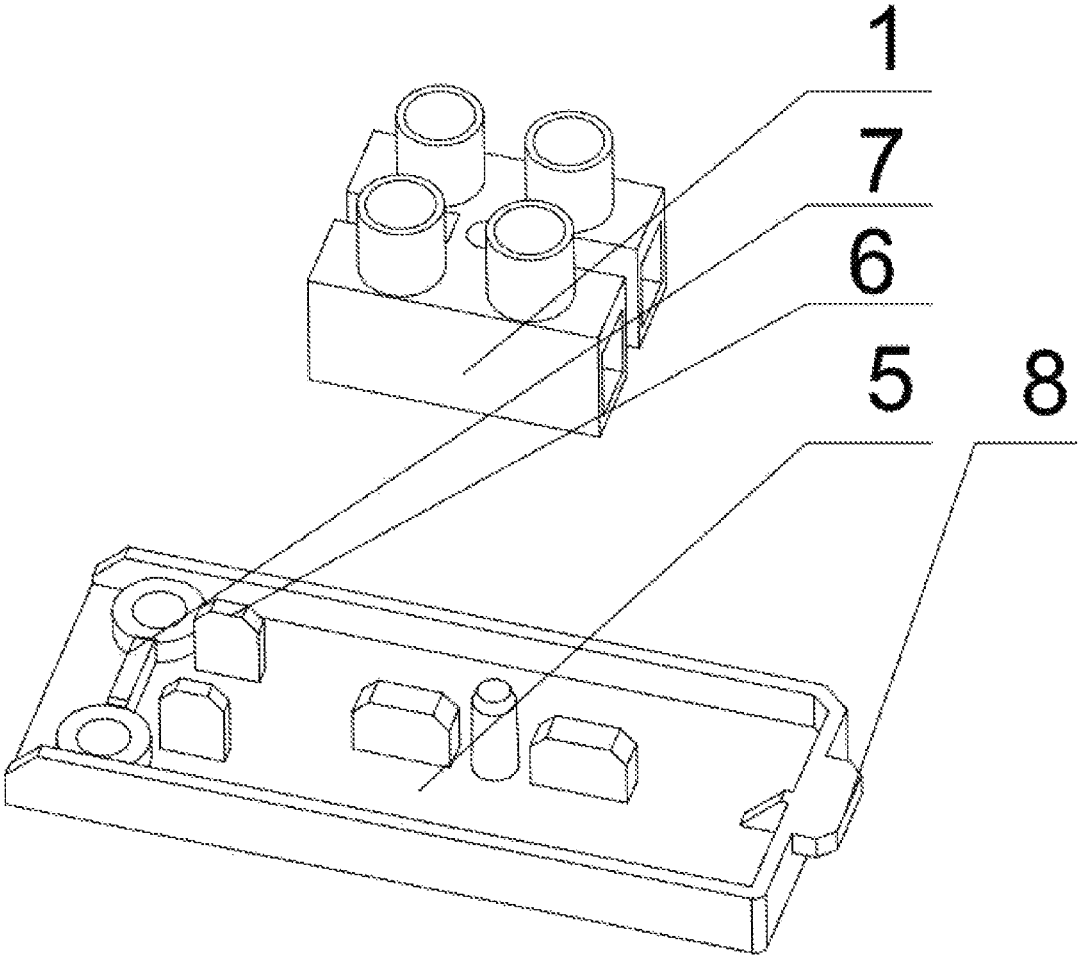
FIG.3 is an exploded view of a terminal cap and a wiring terminal in the down lamp of the present invention.
Figure 4:
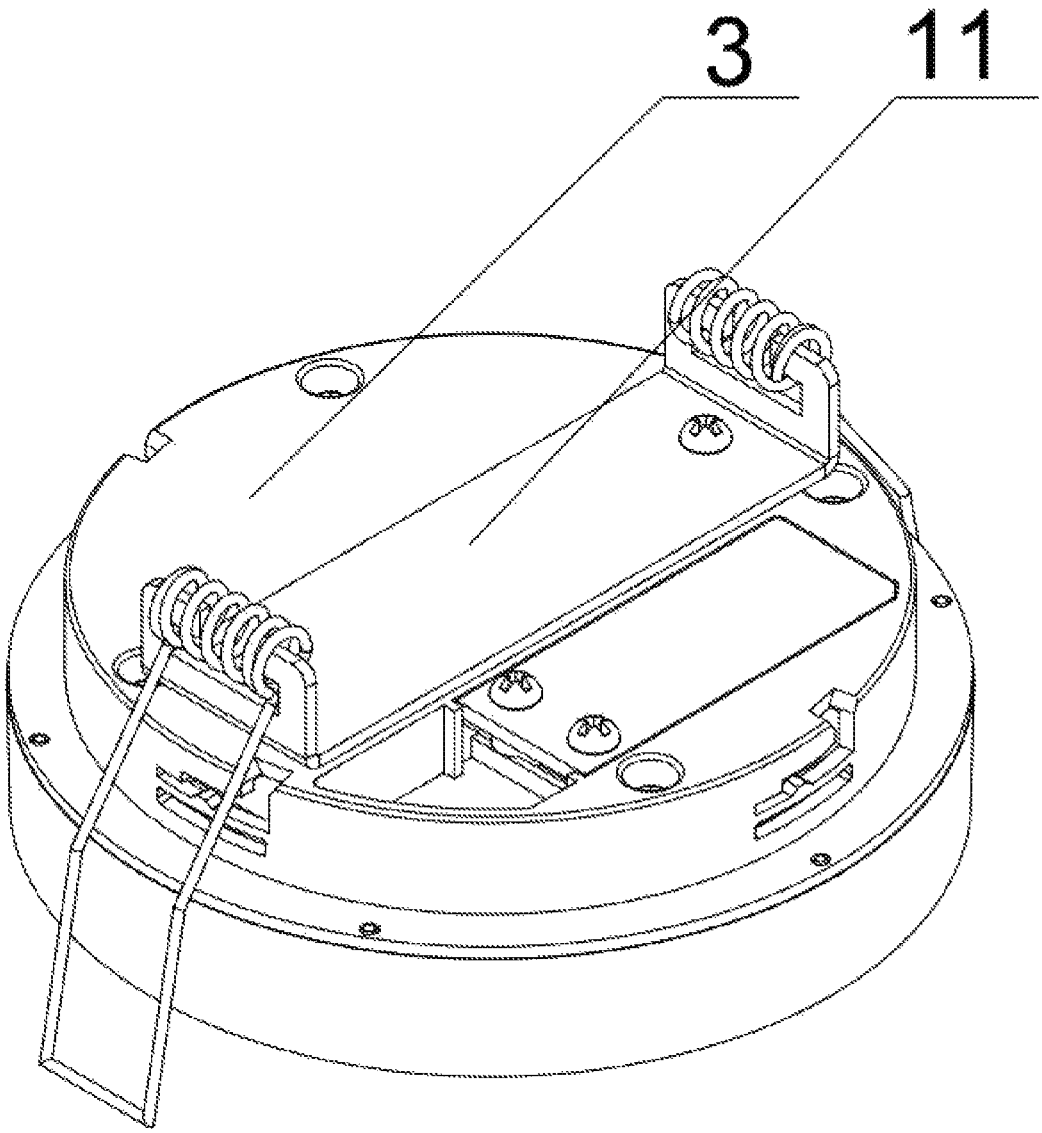
FIG.4 is a schematic structural diagram of matching of the down lamp of the present invention and a first mounting base.
Figure 5:
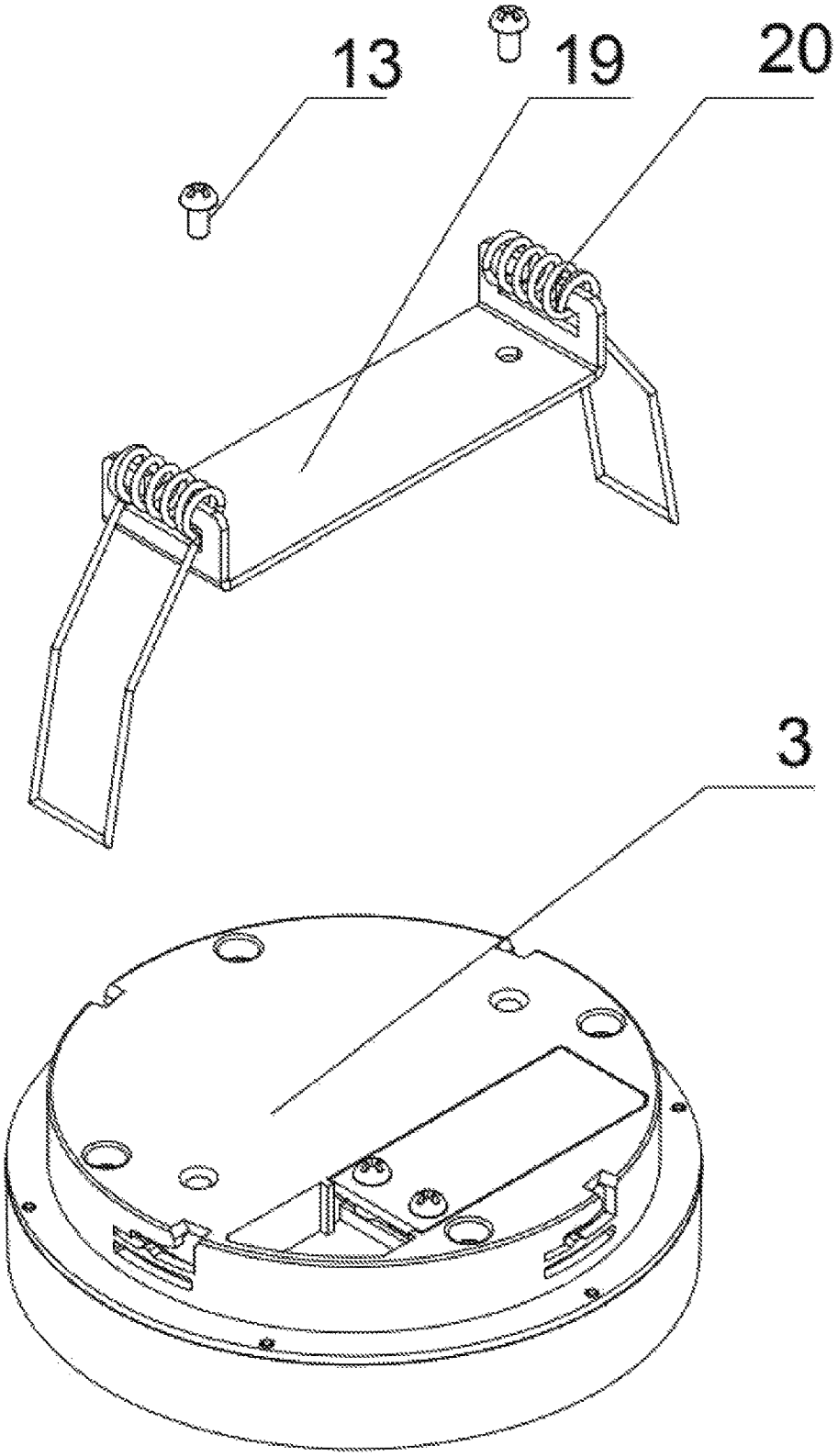
FIG.5 is an exploded view of matching of the down lamp of the present invention and the first mounting base.
Figure 6:
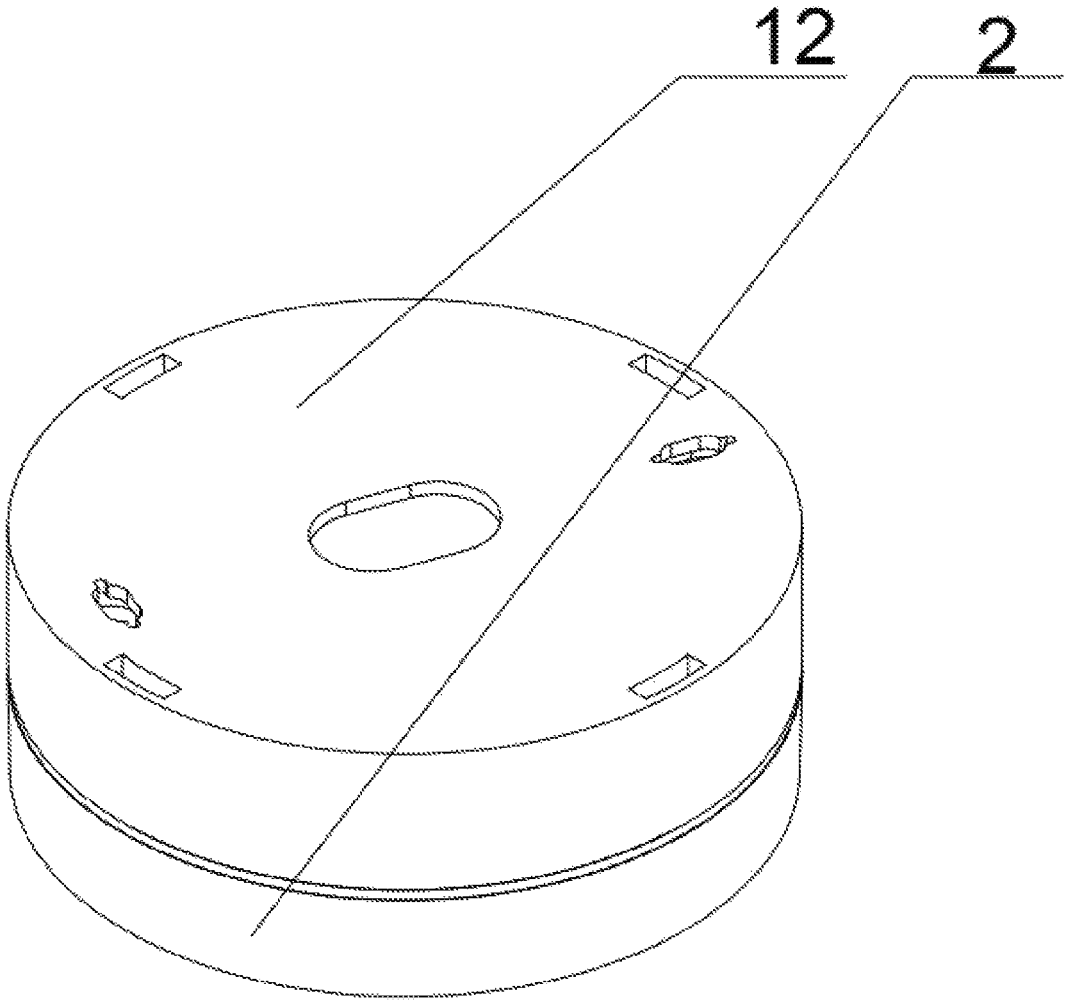
FIG.6 is a schematic structural diagram of matching of the down lamp of the present invention and a second mounting base.
Figure 7:
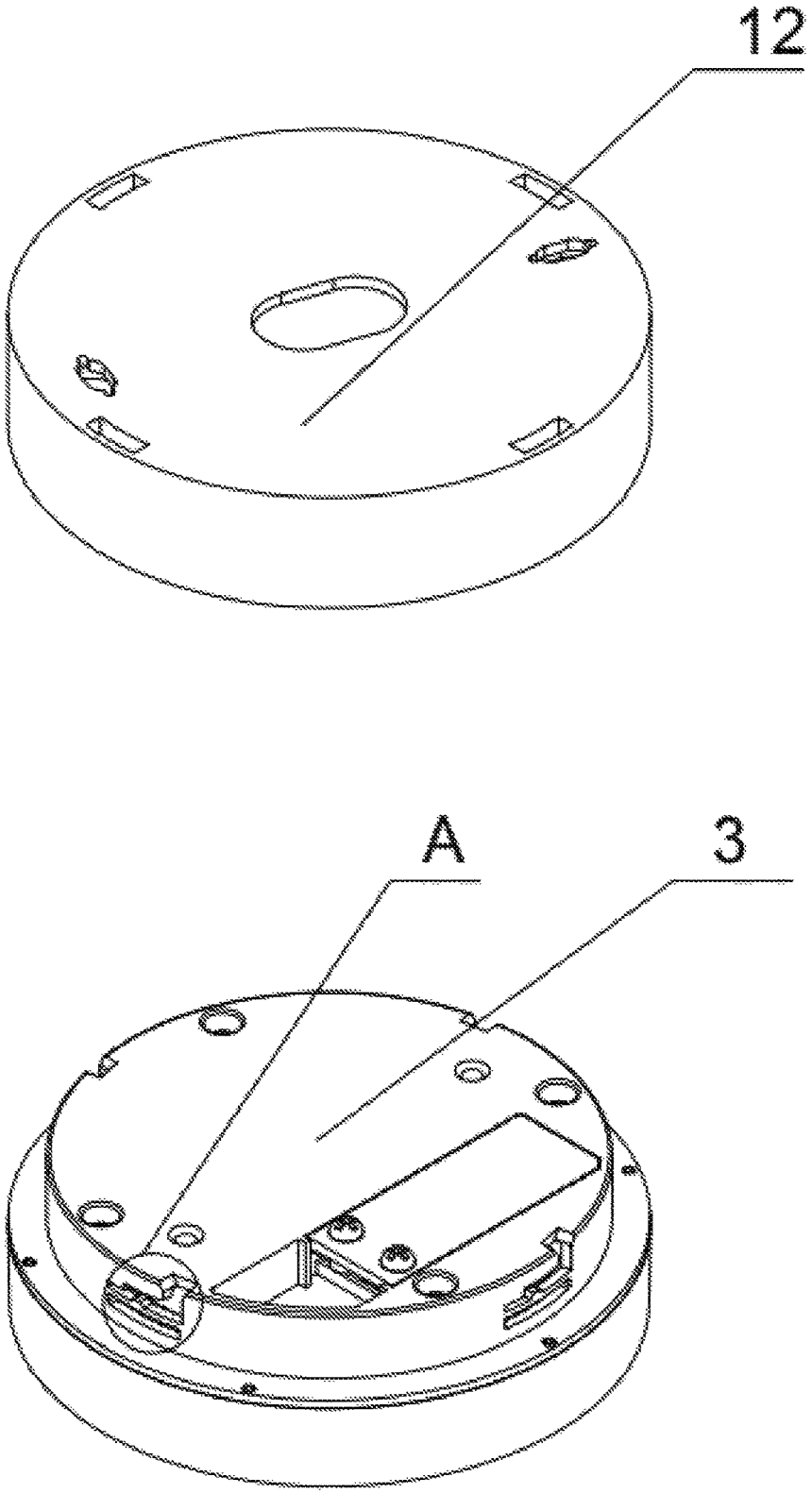
FIG.7 is an exploded view of matching of the down lamp of the present invention and the second mounting base.
Figure 8:
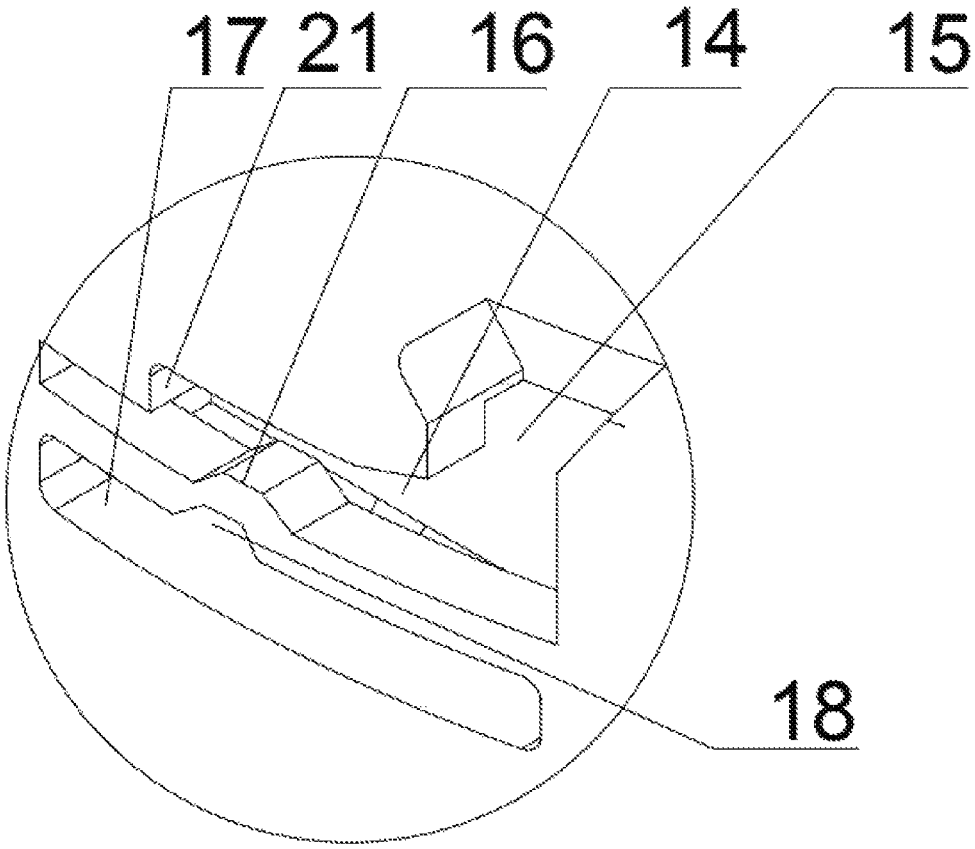
FIG.8 is an enlarged view of area A in FIG.7.

The reference numerals denote that: 1 wiring terminal; 2 front shell; 3 rear cap; 4 opening; 5 terminal cap; 6 wire guiding structure; 7 wire pressing block; 8 insertion piece; 9 supporting rib; 10 slot; 11 first mounting base; 12 second mounting base; 13 screw; 14 clamping slot; 15 gap; 16 positioning bar; 17 subsidiary slot; 18 recess; 19 mounting bracket; 20 spring buckle; 21 stop block.

DETAILED DESCRIPTION OF THE EMBODIMENTS

The present invention will be further described by referring to the embodiments, but is not intended to be limited thereto.

In an embodiment, a down lamp comprises a housing, mounting bases arranged outside the housing and a wiring terminal 1 arranged in the housing. Actually, the housing is also internally provided with a control panel, a drive plate, a light source and other structures that are not involved in the technical solution claimed by the present application, therefore, details about these structures are not given below.

The housing comprises a front shell 2 and a rear cap 3. The rear cap 3 has an opening 4 on which a terminal cap 5 is arranged.

The terminal cap 5 is successively provided with a buckle group, a wire guiding structure 6, a wire pressing block 7 and a mounting structure, and the buckle group comprises a columnar positioning structure and two blocky positioning structures, and a clamping slot for embedding in of the columnar positioning structure and two blocky positioning structures is formed in the wiring terminal 1, such that the wiring terminal 1 and the terminal cap 5 are in buckled connection.

The wire guiding structure 6 comprises two guide plates. A connecting wire extending out from the opening of the wiring terminal 1 is guided by the two guide plates.

The mounting structure refers to two screw mounting holes. The terminal cap 5 is locked on the rear cap 3 via screws.

The wire pressing block 7 is arranged between the two screw mounting holes, mainly for tightly pressing the guided connecting wire.

The opening 4 of the rear cap 3 is provided with a support rib 9 and a slot 10 for insertion of an insertion piece 8 that is arranged on the terminal cap 5. Therefore, when the terminal cap 5 needs to be mounted on the rear cap 3, the insertion piece 8 on the terminal cap 5 is inserted into the slot 10, next the terminal cap 5 is integrally placed in the opening 4 and supported by the support rib 9, after that, the terminal cap 5 is completely locked on the rear cap 3 via screws so as to complete mounting. During disassembly, screws are unscrewed, and then the terminal cap 5 is conveniently taken out, thus being convenient to assemble and dissemble.

The mounting bases comprise a first mounting base 11 and a second mounting base 12, and the first mounting base 11 comprises a mounting bracket 19 and spring buckles 20 at two sides of the mounting bracket 19. Two screw mounting holes are formed in the middle of the mounting bracket 19. Another screw mounting hole is also formed in the corresponding location of the rear cap 3. The mounting bracket 19 is mounted on the rear cap 3 via screws 13. After the first mounting base 11 is mounted on the rear cap 3, the down lamp can be directly and integrally mounted in an embedded-in manner.

The second mounting base 12 comprises a base body and a lug arranged in the base body. A clamping slot 14 is provided on the periphery of the rear cap 3. The clamping slot 14 is provided with a gap 15 for stretching in of the limiting lug at one side, and a positioning bar 16 and a stop block 21 at the other side. The lug is embedded in the clamping slot 14 and then clamped between the positioning bar 16 and the stop block 21. One side of the positioning bar 16 distal to the gap 15 is provided with a subsidiary slot 17 of which the portion proximal to the positioning bar 16 has a recess 18. The base body of the second mounting base 12 and the rear cap 3 are in rotary buckling. After the second mounting base 12 is mounted on the rear cap 3, the whole down lamp can be directly mounted.

It should be noted that, the above embodiments are merely illustrative, rather than restrictive, for the technical solution of the present invention. However, detailed explanations about the present invention have been given in combination with the above embodiments, an ordinary skilled person should be understood that, any amendments to the technical solution of the embodiments, or any equivalent substitutions for a portion of technical features therein are allowed. But these amendments or substitutions shall not make the corresponding technical solution depart from the spirit and scope of the present invention.

We claim:

1. A down lamp, comprising a housing and a wiring terminal (1) disposed in the housing, and the housing comprises a front shell (2) and a rear cap (3), wherein the rear cap (3) has an opening (4) at the location corresponding to the wiring terminal (1) and the opening (4) is provided with a terminal cap (5) that is matched with the opening and is in detachable connection with the rear cap (3);

wherein the down lamp further comprises a first mounting base (11) connected to the rear cap (3) for embedded-in mounting of the down lamp, and a second mounting base (12) detachably connected to the rear cap (3) for surface mounting of the down lamp.

2. The down lamp of claim 1, wherein the wiring terminal (1) and the terminal cap (5) are in detachable connection.

3. The down lamp of claim 2, wherein the terminal cap (5) and the wiring terminal (1) are in buckling connection.

4. The down lamp of claim 1, wherein the terminal cap (5) is provided with a wire guiding structure (6) for guiding a connecting wire extending out from the wiring terminal (1).

5. The down lamp of claim 1, wherein the terminal cap (5) is provided with a wire pressing block (7) for tightly pressing a connecting wire extending out from the wiring terminal.

6. The down lamp of claim 1, wherein the terminal cap (5) is provided with an insertion piece (8), and the opening of the rear cap (3) has a supporting rib (9) and a slot for insertion (10) of the insertion piece (8).

7. The down lamp of claim 1, wherein the first mounting base (11) is detachably connected to the rear cap (3) through screws, and the second mounting base (12) and the rear cap (3) are in rotary buckling.

8. The down lamp of claim 7, wherein the rotary bucking between the second mounting base (12) and the rear cap (3) is that there is a clamping slot (14) in the rear cap (3), a lug matched with the clamping slot (14) is disposed on the second mounting base (12), and the clamping slot (14) is provided with a gap (15) for stretching in of a limiting lug at one side, and the clamping slot (14) is provided with a positioning bar (16) for clamping the limiting lug into the clamping slot (14) at the other side.

9. The down lamp of claim 8, wherein one side of the positioning bar (16) far away from the gap (15) is provided with a subsidiary slot (17), and the portion of the subsidiary slot (17) proximal to the positioning bar (16) is provided with a recess (18).

* * * * *